US005978962A

United States Patent [19]

Hamowy

[11] Patent Number: 5,978,962

[45] Date of Patent: Nov. 9, 1999

[54] INTEGRATED KNEE OR ELBOW PROTECTOR AND PLUSH TOY

[75] Inventor: Lewis Hamowy, Brooklyn, N.Y.

[73] Assignee: Cycle Express, Inc., New York, N.Y.

[21] Appl. No.: 09/100,281

[22] Filed: Jun. 19, 1998

[51] Int. Cl.[6] ..... A41D 13/08

[52] U.S. Cl. ..... 2/16; 2/24; 2/911; 602/26; 602/62

[58] Field of Search ..... 2/16, 22, 24, 911, 2/75, 80; 446/26, 28; 602/20, 21, 23, 26, 62, 63

[56] References Cited

U.S. PATENT DOCUMENTS

| | | | |
|---|---|---|---|
| D. 327,961 | 7/1992 | Decker . | |
| D. 335,000 | 4/1993 | Johnson . | |
| D. 343,513 | 1/1994 | DiTizio . | |
| 2,795,791 | 6/1957 | Haslett . | |
| 4,484,361 | 11/1984 | Leighton et al. | 2/24 |
| 4,595,618 | 6/1986 | Caringer . | |
| 4,662,550 | 5/1987 | O'Donnell . | |
| 4,871,178 | 10/1989 | Diaz . | |
| 4,953,569 | 9/1990 | Lonardo | 2/16 |
| 4,973,106 | 11/1990 | Strovinskas . | |
| 5,078,640 | 1/1992 | Berman . | |
| 5,209,691 | 5/1993 | Ekstein | 446/26 |
| 5,255,834 | 10/1993 | Bendersky . | |
| 5,537,689 | 7/1996 | Dancyger | 2/24 |
| 5,592,689 | 1/1997 | Matthews . | |
| 5,742,939 | 4/1998 | Williams | 2/24 |
| 5,781,935 | 7/1998 | Bassett et al. | 2/24 |

*Primary Examiner*—Michael A. Neas
*Assistant Examiner*—Gary L. Welch
*Attorney, Agent, or Firm*—Levisohn, Lerner, Berger & Langsam

[57] ABSTRACT

A knee, elbow or other body part protector includes a playful, fanciful or novelty feature, figure or object that is not related to safety integrated therewith. A protective portion of the protector and the figure or object are integrated into the protector so as to provide protection or safety while also lending enjoyment, satisfaction or entertainment to the wearing of the protector. Such protectors are particularly attractive to young children to induce the children to wear them. The integration into the protector of the protective portion and the figure or object can be one of relative location or one in which part or all of the protective portion forms part of the feature or object, which can be defined graphically, by surface ornamentation and/or by one or more three-dimensional objects. Other parts of the protector, e.g., straps or an elastic sleeve, may be integrated into the figure or object. The figure may be a teddy bear or other animal having a head, front and hind legs all of which are plush and a tummy formed by a protection portion integrated with the head and eyes.

20 Claims, 1 Drawing Sheet

INTEGRATED KNEE OR ELBOW PROTECTOR AND PLUSH TOY

BACKGROUND OF THE INVENTION

This invention relates to protective gear for elbows, knees or other joints and body parts with an integrated toy or novelty figure or object.

Pads, braces, straps and other protective gear have long been used to protect body parts such as knees, elbows and other joints and extremities that could be harmed by impact during certain activities, for example, play, athletics, exercise and work. Typically, elbow or knee pads have a cushioned, protective pad to which either an elastic sleeve or straps are attached for holding the pad in the desired location with respect to the joint to be protected. The pad is generally resilient in order to cushion an impact and may also have a hard protective shield at the front side of the pad for additional safety. Although the use of such protective gear is encouraged and is widespread, many who should wear such protective gear do not.

Children, adolescents and adults all risk injury when performing certain physical activities, such as skating, and would benefit from wearing protective gear of the type described herein. Despite these benefits, many in each group resist wearing, or do not wear, such protective gear.

In the case of children, they often do not appreciate the inherent danger in many activities and are, therefore, unwilling to wear protective gear for various reasons ranging from physical inconvenience or discomfort to a perception that wearing protective gear is an indication for all to see that they are not proficient at the particular activity involved. Precisely because children do not recognize the risk and believe that they are more accomplished at the particular activity than they in fact are, they may act recklessly. Therefore, it is important that they wear appropriate protective gear while engaged in certain activities. Accordingly, there is a need to induce children to more willingly wear elbow pads, knee pads and other protective gear.

In the case of adolescents and adults, many recognize the benefits of wearing such protective gear during certain activities, yet some refuse to wear the protective gear.

There is therefore a need, which the invention herein satisfies, to induce persons of all ages to wear appropriate protective gear while engaged in certain activities of an athletic nature, as described above.

SUMMARY OF THE INVENTION

It is, therefore, an object of this invention to induce the wearing of appropriate protective gear during certain play, athletic, exercise and work activities.

Simply wearing ordinary protective gear, separate and apart from engaging in the activity during which protection is desired, provokes no entertaining or enjoyable or satisfying or artistic reaction or appreciation, and provides no entertainment value or enjoyment to children, adolescents or adults. Similarly, selecting the protective gear does not provoke any such reaction or appreciation or provide any such value. The same can be said for observation of individuals wearing the protective gear. The inventor recognized this lack of reaction, appreciation or value (referred to below and in the claims simply as "entertainment value"), leading to the invention disclosed herein.

A further object of the invention is to take advantage of this possible entertainment value in inducing persons to wear appropriate protective gear while engaging in certain activities.

More specifically, it is another object of this invention to provide protective gear for protecting a person's knee, elbow or other joint or body part during certain play, athletic, exercise and work activities, which protective gear offers entertainment value in addition to physical protection.

The invention fulfills the needs described above and accomplishes the above objects by providing protective gear with the joint capability of protecting a person's joints and other body parts during certain activities and of providing entertainment value. In accordance with the invention, protective structure and parts of a novelty, fanciful or toy figure or object are integrated, and together portray a unified figure or object of which the protective structure is part. This unified figure or object, embodied in an otherwise purely functional and safety-directed item, provides the protective gear with the capability of entertaining the wearer, thereby inducing its use.

As mentioned above, the entertainment value can take many forms. For example, a young child can take pleasure in wearing a plush teddy bear or other animal, or a character-licensed type of figure, such as Mickey Mouse. An adolescent, on the other hand, may take pleasure from wearing a plush representation of a rock artist. Adults may prefer adult themes, or artistic themes, etc. The exact figure or object integrated with the protective structure is, of course, limited only by one's imagination.

The integration of the protective structure and the figure or object can be one of relative location or one in which part or all of the protective structure forms part of the feature or object, which can be defined graphically or by surface ornamentation and/or by one or more three-dimensional objects. Parts of the protective gear other than the protective structure, e.g., straps or an elastic sleeve, may be integrated into the figure or object.

The invention provides an article of protective gear for protecting an elbow, knee or other part of a human body, comprising a protective portion, means for holding the protective portion in a protective position adjacent the body part, and a figure or object, capable of providing an entertainment value, integrated into the protective gear and defined in part by the protective portion.

As mentioned, the figure may comprise three-dimensional portions (e.g., plush), surface ornamentation or graphics carried by the article. The figure or object may represent an animate figure having a head, limbs and a torso or other mid-section. In the illustrated embodiment, the figure or object is that of a three-dimensional animal, specifically, a teddy bear that includes a plush head, plush arms, plush legs and a plush torso or tummy, all integrated into the protective pad. In another embodiment, the head, arms and legs are more or less conventional plush, but the tummy or torso is equipped with a protective shield, all of which are integrated to portray the teddy bear in a unified fashion.

In the case of a knee or elbow pad, the protective gear includes an elastic sleeve, straps or some other means for securing the protective gear to the wearer's elbow or knee.

Other embodiments are possible in which the protective pad or shield forms a different part of the figure, or the figure is defined by surface ornamentation and/or graphics on the protective pad, shield and other parts of the protective gear in a unified fashion, or the figure is defined by a combination of three-dimensional parts, graphics and/or surface ornamentation.

BRIEF DESCRIPTION OF THE DRAWINGS

The above and other objects and advantages of the invention will be more apparent upon consideration of the following detailed description, taken in conjunction with the accompanying drawings, in which the same reference characters in different figures refer to the same or similar parts, and in which.

DETAILED DESCRIPTION OF THE INVENTION

Figure 1:
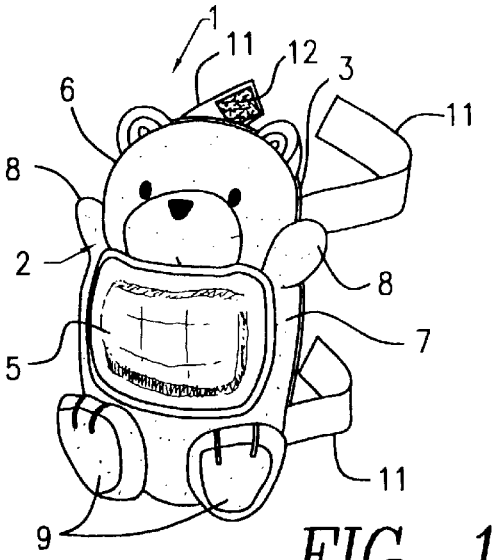
FIG. 1 is a perspective view of a knee protector constructed in accordance with a first embodiment of the present invention, which includes three-dimensional plush parts and a protective shield integrated into a teddy bear figure.

Referring now to the drawings of the invention, FIG. 1 shows a first embodiment of an article of protective gear, in this instance a knee pad, generally designated as 1, having a feature, structure or object that is not related to the safety of the protective gear integrated into the protective portion of the knee or elbow pad. In this embodiment, the non-safety related feature, structure or object is a fanciful plaything 2. Reference throughout this application to "plaything", unless otherwise specifically limited, refers to a compressible, three-dimensional article that simulates, in either appearance or use, an animate object (such as an animal or a face), an inanimate object (such as a football or a piano) or some other novelty figure or character. The significance of the broadest aspect of this invention is that the plaything, although simulating in either appearance or use an animate or inanimate object or some other novelty figure or character, is integrated within and is usable as part of the protective portion of the protective gear in order to provide protection for a user's elbow or knee joint and entertainment value for the wearer during the period in which the gear is worn.

Figure 2:
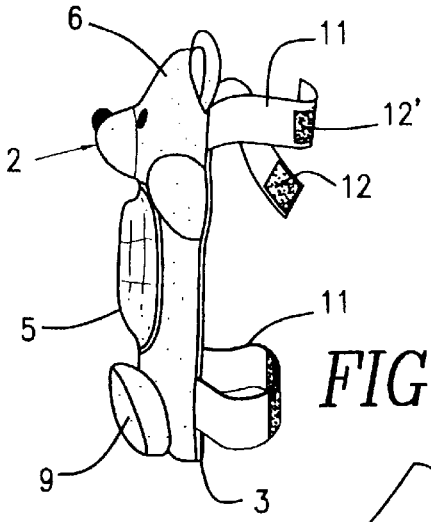
FIG. 2 is a side view of the knee protector of FIG. 1.
Figure 3:
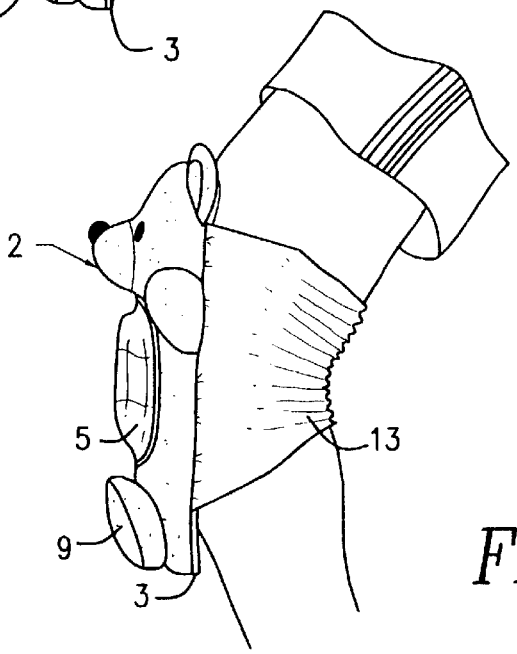
FIG. 3 is a side view of the knee protector of FIG. 1 shown being worn on the flexed knee of a user, including an elastic sleeve for securing the protector to the knee area.

As shown in FIGS. 1–3, knee pad 1 has a rigid backing 3 that establishes the shape for protective gear 1 and typically, as with standard protective gear, has a padded or cushioned front side that provides cushioning for the wearer's joint. In general, plaything 2 can be integrated, incorporated or unified into protective gear 1 in a wide variety of forms. In the first embodiment, plaything 2 is integrated into the front side of knee pad 1 by use of surface ornamentation and three-dimensional objects such that the front face of pad 1 has the appearance of a plaything 2 or plush figure, such as a stuffed animal or another stuffed object. More particularly, plaything 2 is illustrated as being in the form of a stuffed teddy bear having a head 6, torso 7, two arms 8 and two legs 9, all of which are three-dimensional and are integrated to portray plaything 2 in a unified fashion.

The stuffed teddy bear, and indeed most other embodiments in which plaything 2 is three-dimensional, is provided with a layer of outer casing external to the front face of pad 1. The outer casing can be made of any desirable material and is stuffed with a soft, compressible filler material. Most preferably, however, when plaything 2 is in the form of a stuffed animal, at least that portion of the casing that is readily visible should be made of a plush-like material that is soft in order to simulate the skin or fur of the animal. The outer casing is formed from a plurality of discrete panels that are typically sewn or stitched together in a conventional and well-known manner. The soft, compressible filler material can likewise be made of any suitable material employed for stuffed animals, cushions or pillows. It should be understood that the particular materials used to form the outer casing and the soft compressible filler material do not constitute limitations on the present invention, as such materials are well known in the art of manufacturing stuffed animals and other plush toys and compressible objects, such as pillows or cushions.

As shown in FIGS. 1–3, knee pad 1, as with standard protective gear, has a resilient protective shield 5 located at the front of pad 1 to further protect the knee against forceful impact. Protective shield 5 is most preferably, formed of hard material, such as metal or a hard, injection-molded plastic that is known for having strength properties, being lightweight and being inexpensive to manufacture and that would provide a sufficient shield against forceful impact. Plaything 2 is further integrated or unified into the protective portion of protective gear 1 by locating shield 5 on plaything 2 so that it appears to be part of plaything 2, while still affording maximum protection for the joint of the wearer. For example, as shown in the embodiment of FIGS. 1–3, shield 5 could be formed centrally of plaything 2, such as within the tummy region of midsection or torso 7. Placement of shield 5 within torso 7 of stuffed animal plaything 2 also allows shield 5 to be "hidden" within the body of plaything 2 so that a child user will be more aware of the entertainment value provided by wearing plaything 2 than of wearing protective gear 1.

Figure 4:
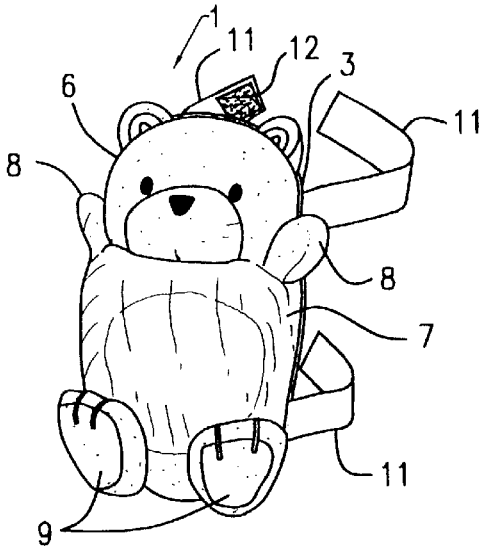
FIG. 4 is a perspective view of a knee protector constructed in accordance with a second embodiment of the present invention, which includes three-dimensional plush parts integrated into a teddy bear figure.

FIG. 4 shows an alternative embodiment of the integrated protective gear 1 and plaything 2 in which the protective portion of pad 1 is unified with plaything 2 without the use of shield 5. As discussed previously, torso 7 of plaything 2 has a soft outer casing stuffed with a soft, compressible filler material. When so constructed, torso 7 provides cushioning for the wearer's joint in addition to the protective portion of pad 1 already present. In order to properly integrate plaything 2 within protective pad 1, outer casing of torso 7 should be formed of material appropriate for the appearance of plaything 2.

Protective gear 1 must be secured to the joint, in this case the knee, of the wearer and must hold the protective portion, in particular shield 5, in place for protecting and cushioning the knee from impact. Typically, as shown in FIGS. 1–2 and 4, protective gear 1 uses a set of straps 11 that encircle the wearer's joint and hold protective gear 1 in place securely against it. Straps 11 may be adjusted relative to each other in various ways, such as by hook and loop elements 12 and 12', respectively, or by a buckle. Alternatively, as shown in FIG. 3, protective gear 1 may utilize an elastic strip or sleeve 13 that surrounds the joint to be protected and holds protective gear 1 in the desired location for protection of the child's knee. Attachment of straps 11 or elastic sleeve 13 to protective gear 1 may be made by any of the known means in the art, such as by sewing or stitching the material of the casing of plaything 2 or the material of rigid backing 3 to the edges of straps 11 or an elastic strip or sleeve 13. Generally, in construction, the ends of straps 11 or of elastic strip or sleeve 13 are sewed sandwiched between plaything 2 on the front of protective gear 1 and rigid backing 3 on its rear. This attachment could also be accomplished by glue or other adhesion.

Figure 5:
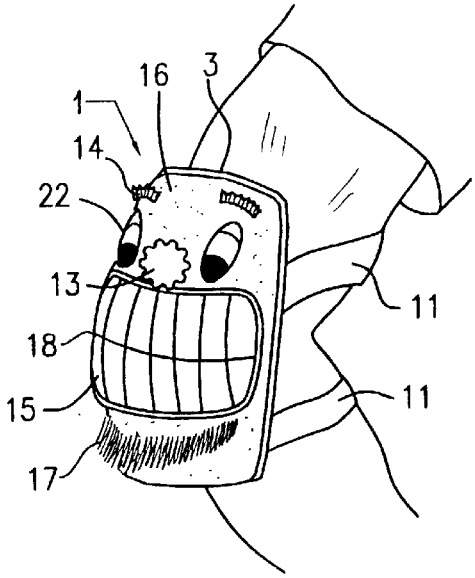
FIG. 5 is a perspective view of an elbow protector constructed in accordance with a third embodiment of the invention, shown being worn on the flexed elbow of a user, which protector includes a protective shield integrated in a fanciful, two- or three-dimensional face representation.

In yet another embodiment of this invention, the non-safety related feature, structure or object of this invention may be integrated or unified into the protective gear in ways other than by a three-dimensional plaything. For example, the non-safety related feature, structure or object may form part or all of the structure of protective gear and may be completed by graphics or by surface ornamentation, perhaps even in combination with three-dimensional objects, the combination being referred to herein simply as a playful figure. As shown in FIG. 5, in a third embodiment of this invention, the non-safety related feature, structure or object of the invention is integrated or unified within the protective gear, shown being worn on an elbow, and is defined predominantly either graphically, by surface ornamentation or by both. The protective structure of gear 11 may form part or all of the playful figure or object that is completed by graphics or by surface ornamentation.

As illustrated in FIG. 5, protective pad 11 has rigid backing 3 that establishes the shape of protective gear 11 and typically, as with standard protective gear, has a padded front side 16 that provides additional cushioning. In this second embodiment, the playful, non-safety related figure is integrated into front side 16 of knee pad 11 such that front side 16 of pad 11 has the appearance of a clown's face. More particularly, by graphics or by surface ornamentation, eyes 22, nose 13, eyebrows 14, teeth 18 and beard 17 are depicted on front side 16 of pad 11. This depiction of the playful figure could be done by using two-dimensional means such as paint, decals or the like, or by using three-dimensional means such as the type normally used with dolls, stuffed animals or other plush toys, or by using any combination thereof. Of course, it should be noted that various different types of playful figures can be depicted on protective gear 11, such as depictions of human, animal or other types of faces, sports equipment, or fanciful objects or devices, without departing from the scope of the invention.

Knee pad 11, as with the first embodiment discussed above, may also have a protective shield 15 located on the front 16 of pad 11 to further protect the knee against forceful impact. The playful, non-safety related figure is further integrated or unified into protective gear 11 by locating shield 15 so that it appears to be part of the playful figure. For example, as shown in FIG. 4, shield 15 could be formed as part of the clown's face, in particular as teeth 18 within the mouth of the clown's face. Placement of shield 15 within the face of the playful, non-safety related figure allows shield 15 to be "hidden" within the figure so that a child user will be more aware of wearing the figure than of wearing protective gear 11. Of course, protective gear 11 could also be formed without shield 15, whereby padding within front 16 of protective gear 11 provides the necessary cushioning for the wearer.

When the user wears the protective gear described herein during activity, he will gain enjoyment and entertainment value from wearing the plaything or other fanciful or novelty figure integrated therewith, thereby achieving both the desired safety effect of protection of the wearer while also providing fun and entertainment value. In this way, the wearer finds usage of the protective gear more desirable through the induced entertainment factor afforded by the invention of the combination of the non-safety related figure, endearing to a child, with customary knee or elbow pad presented herein. A wearer would look forward to wearing protective gear such as elbow pads or knee pads during activity because, when worn, the plaything or fanciful or novelty figure provides the entertainment (and comforting aspects) of a stuffed animal such as a teddy bear, for example, but still becomes part of the positive protective gear wearing pattern, i.e., it promotes, in combination, both the desired safety aspect and an entertainment value.

Thus, a new and improved protective gear is provided. One skilled in the art will appreciate that the present invention can be practiced by other than the described embodiments, which are provided for purposes of illustration and not limitation, and that the present invention is limited only by the claims that follow.

What is claimed is:

1. An article of protective gear for protecting a joint of a body, comprising:

a protective portion;

means for holding said protective portion in a protective position adjacent said body part;

said article being of a size to protect the joint being covered while permitting relatively free movement of the limbs attached to the joint;

a figure integrated into said protective portion, said figure projecting outwardly from aid joint and comprising a child-attractive figure providing entertainment value;

wherein said figure is an animate figure having a head, limbs and a mid-section, wherein at least one of the head and the limbs are three-dimensional and the protective portion defines at least part of the mid-section and comprises a rigid shield region.

2. The article of claim 1 wherein said figure comprises three-dimensional portions carried by the article.

3. The article of claim 2 wherein at least one of said three-dimensional portions are plush.

4. The article of claim 1 wherein said figure comprises portions defined by surface ornamentation carried by the article.

5. The article of claim 1 wherein said figure comprises portions defined by graphics carried by the article.

6. The article of claim 1 wherein said protective portion comprises a compressible padded region.

7. The article of claim 1 wherein said protective portion comprises a compressible padded region.

8. The article of claim 1 wherein said means for holding said protective portion against said joint comprises at least two straps for surrounding said body part and for securing said protective portion in a protective position against said body part.

9. The article of claim 1 wherein said means for holding said protective portion against said body part comprises a resilient band for surrounding said body part for securing said protective portion in a protective position against said body part.

10. An article of protective gear for protecting a joint of a body, comprising:

a protective portion;

means for holding said protective portion in a protective position adjacent said body part;

said article being of a size to protect the joint being covered while permitting relatively free movement of the limbs attached to the joint;

a figure integrated into said protective portion, said figure projecting outwardly from said joint and comprising a child-attractive figure providing entertainment value;

said figure comprising a combination of a head, limbs and a mid-section, said protective portion defining one of said head and said mid-section of said figure;

wherein said protective portion comprises a rigid shield section.

11. The article of claim 10 wherein at least one of the portions of the figure not defined by the protective portion is three-dimensional.

12. The article of claim 11 wherein said at least one portion is plush.

13. The article of claim 10 wherein said figure represents an animal.

14. The article of claim 10 wherein said protective portion comprises a compressible padded region.

15. The article of claim 10 wherein said protective portion comprises a rigid shield region.

16. An article of protective gear for protecting a joint of a body, comprising:

a protective portion;

means for holding said protective portion in a protective position adjacent said body part;

said article being of a size to protect the joint being covered while permitting relatively free movement of the limbs attached to the joint;

a figure integrated into said protective portion, said figure projecting outwardly from said joint and comprising a child-attractive figure providing entertainment value;

said figure comprising a head, limbs and a mid-section, said protective portion defining said mid-section of said figure, and said head and limbs being three-dimensional;

wherein said limbs are the front and hind legs of an animal figure, said protective portion resembles a tummy of said animal figure, and said head and said front and hind legs are plush.

17. The article of claim 16 wherein at least one of the head and said limbs are plush.

18. The article of claim 16 wherein said limbs are the front and hind legs of an animal figure, said protective portion resembles a tummy of said animal figure, and said head and said front and hind legs are plush.

19. The article of claim 16 wherein said protective portion comprises a compressible padded region.

20. The article of claim 16 wherein said protective portion comprises a rigid shield region.

* * * * *